United States Patent [19]

Markwardt

[11] 4,444,447

[45] Apr. 24, 1984

[54] ELECTRICAL WIRE CONNECTOR

[75] Inventor: Terrance L. Markwardt, Maplewood, Minn.

[73] Assignee: Minnesota Mining and Manufacturing Company, St. Paul, Minn.

[21] Appl. No.: 381,340

[22] Filed: May 24, 1982

[51] Int. Cl.[3] ..... H01R 4/24

[52] U.S. Cl. ..... 339/98; 339/97 R

[58] Field of Search ..... 339/98, 97 R, 97 D, 339/99 R, 103 R, 103 M, 95 R, 278 C, 96

[56] References Cited

U.S. PATENT DOCUMENTS

| | | | |
|---|---|---|---|
| 3,708,779 | 1/1973 | Enright | 339/99 R |
| 3,804,971 | 4/1974 | Bazille, Jr. | 339/98 X |
| 3,890,029 | 6/1975 | Izraeli | 339/98 |
| 4,284,316 | 8/1981 | Debaigt | 339/98 |
| 4,326,767 | 4/1982 | Silberkagel | 339/98 |

FOREIGN PATENT DOCUMENTS

| | | | |
|---|---|---|---|
| 1525382 | 4/1968 | France | 339/98 |
| 2414800 | 9/1979 | France | 339/98 |
| 1276449 | 6/1972 | United Kingdom | 339/98 |
| 2080638 | 2/1982 | United Kingdom | 339/98 |

*Primary Examiner*—William R. Briggs

*Attorney, Agent, or Firm*—Donald M. Sell; James A. Smith; Terryl K. Qualey

[57] ABSTRACT

An electrical wire connector having a hollow, open-topped insulating body and an insulating cover formed to telescope with the body, the body and cover having complementary latches to retain them in an open position for insertion of wires and also to retain them in the closed position fully telescoped together. A slotted, flat plate, copper alloy wire connector element is retained on the base of a U-shaped wire cut-off and strain relief element centrally within the body. The wire cut-off and strain relief element is formed of a metal having a hardness greater than that of the wire connector element to provide the softer metal needed for the electrical contact in the connector element while providing the desired harder metal for cutting the wires and providing strain relief.

6 Claims, 6 Drawing Figures

ELECTRICAL WIRE CONNECTOR

FIELD OF THE INVENTION

The present invention relates to an electrical wire connector for simultaneously connecting, severing and strain relieving electrical wires.

BACKGROUND OF THE INVENTION

Connectors for terminating electrical wires have most often required the wire ends to be pushed into openings in one end of the connector until they contact an abutment within the connector. Telescoping parts have been moved together to force the wires into a contact element to complete the electrical connection. A waterproof grease is frequently provided between the telescoping parts to make the final connection water resistant. Such connectors are disclosed in U.S. Pat. Nos. 3,573,723 and 3,656,088. It has been found that users of such connectors sometimes do not insert the wire ends far enough into the connectors and electrical connection is not made when the parts are moved together. Also, it has been found that occasionally plastic wire insulation stretches sufficiently that it extends beyond the conductor so that even though the wire end is inserted into the connector against the abutment, only the wire insulation is forced into the contact element and again the wire connection is not made.

The wire connector disclosed in U.S. Pat. No. 4,326,767 has eliminated the foregoing problems by providing for extending the wire through the connector and severing the wire within the connector as the parts are telescoped together to make connection to the wires. However, in the connector of that patent the wire connector element and the cut-off blade are all part of a single piece of metal which must be of a copper alloy to make proper electrical connection to the wires. It has been found with the larger wire sizes the wire severing ability of the material which must be used for the wire connection is not as great as would be desired. Moreover, reliance on strain relief by the plastic parts as in the connector of the patent has also been less than desired for some applications.

SUMMARY OF THE INVENTION

The present invention provides an electrical wire connector having an insulating body, an insulating cover, a wire connector element and a wire cut-off and strain relief element. The insulating body is hollow and open-topped with a base wall and a pair of generally parallel side walls extending generally perpendicularly from the base wall. The wire connector element is a flat plate formed of a copper alloy with a plurality of wire connecting slots and it is retained in the body perpendicular to the side walls and the base wall generally centrally of the length of the body for electrical connection of a plurality of insulated wires. The wire cut-off and strain relief element is U-shaped and is formed of a metal having a hardness greater than that of the wire connector element. It has a base passing between the base wall of the body and the wire connector element and end walls parallel to the flat plate wire connector element. One of the end walls is sharpened along its top edge in alignment with at least one of the wire connecting slots and the wire connector element and the second end wall comprises at least one leg projecting transversely into the path of a wire from each wire connecting slot to the end of the insulating body adjacent the second end wall to engage the insulation of the wire and thereby to strain relieve the wire. The insulating cover is formed to telescope with the body and it has means to carry a wire into each wire connector element slot and to cooperate with the sharpened end wall of the wire cut-off and strain relief element to sever at least one wire extending through the connector upon telescoping of the cover and the body fully together. The body and cover are formed with complementary latch members to retain the body and cover in an open position to permit one wire for each wire connecting slot in the wire connector element to be inserted through the connector between the body and cover and to retain the body and cover in a crimped position with the cover and body fully telescoped together.

The wire connector element is made of a copper alloy to provide proper electrical connection to the wires. The wire cut-off and strain relief element is formed of a metal having a hardness greater than that of the wire connector element to provide the desired harder wire cut-off and at the same time using the harder metal to provide strain relief between the wire connection and the end of the connector.

THE DRAWINGS

DESCRIPTION OF THE PREFERRED EMBODIMENT

Figure 1:
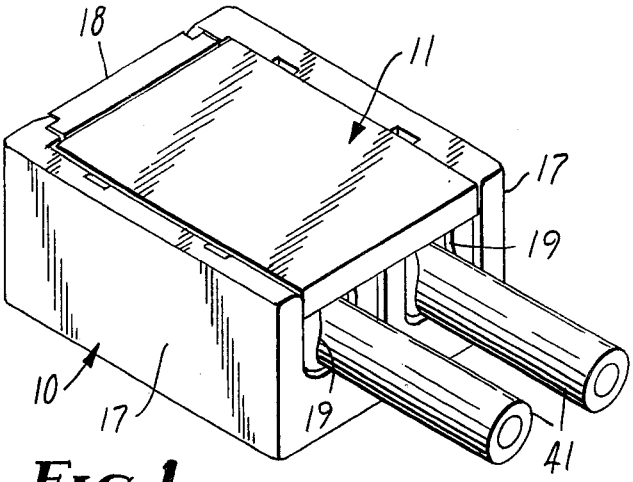
FIG. 1 is an isometric view of an electrical wire connector constructed in accordance with the present invention in a fully closed position with two wires connected and strain relieved therein.
Figure 2:
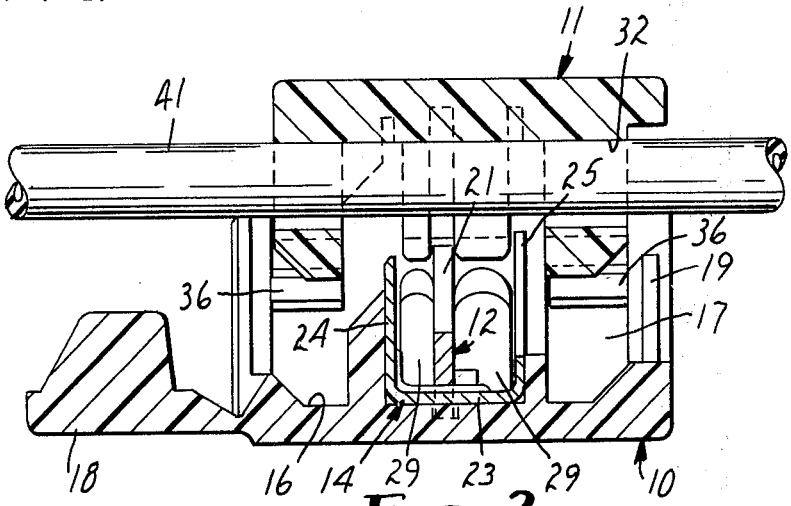
FIG. 2 is a longitudinal cross sectional view of the connector of FIG. 1 in the fully open position prior to connecting the wires.
Figure 3:
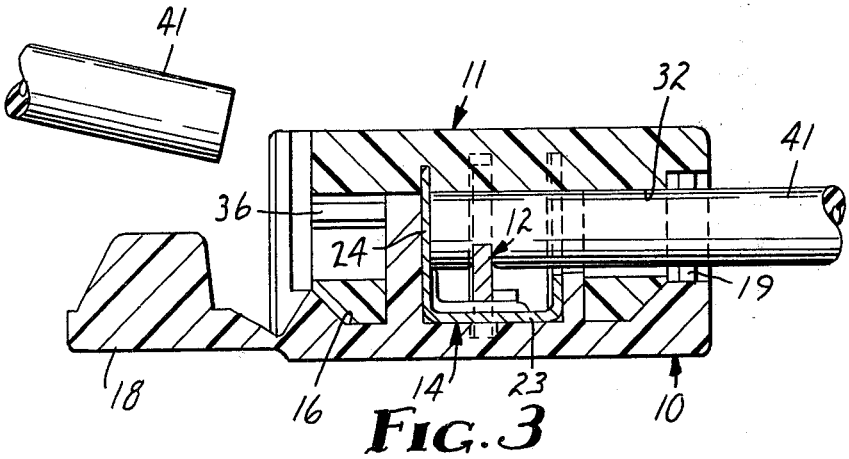
FIG. 3 is a view similar to that of FIG. 2 as the parts are fully telescoped together to sever, connect and strain relieve the wires.

The electrical wire connector of the present invention comprises an insulating body 10, an insulating cover 11, a conductive wire connector element 12 and a metal wire cut-off and strain relief element 14.

The body 10 is hollow and open-topped with a base wall 16 and a pair of generally parallel side walls 17 extending generally perpendicularly from the base wall. A door 18 is hinged on one end of the body 10 and it may be closed after the cover 11 is telescoped into the body 10 to seal off the end of the connector. At the opposite end, the body is formed with a pair of wire entry slots 19 to assist in defining the wire path through the connector.

The wire connector element 12 is a flat plate of a copper alloy formed with a plurality of wire connecting slots 21. The wire cut-off and strain relief element 14 is U-shaped, as viewed from either side of the connector, and is formed of a metal having a hardness greater than that of the wire connector element 12. It has a base 23 and end walls 24 and 25, one end wall 24 being sharpened along its top edge and the opposite end wall consisting of two similar legs 25, one extending inward from each edge of the element 14. The wire connector element 12 is preferably formed of three quarter hard 260 cartridge brass and the wire cut-off and strain relief element 14 is preferably formed of half hard 301 stainless steel.

The wire connector element 12 is formed at its ends along its lower edge with tabs 27 to frictionally engage the ends of the base 23 of the wire cut-off and strain relief element 14 to retain the wire connector element 12 on the wire cut-off and strain relief element 14. A pair of opposed posts 29 project inward from the side walls 17 of the body 10, each post 29 being formed with a slot 30 to receive one end of the wire connector element 12 to frictionally engage the wire connector element 12 and thereby to retain both elements 12 and 14 in the body 10. Thus, the wire connector element 12 is retained in the body 10 perpendicular to the side walls 17 and base walls 16 centrally of the length of the body for electrical connection of two insulated wires. The base of the wire cut-off and strain relief element 14 passes between the base wall 16 of the body 10 and the wire connector element 12, and the end walls 24 and 25 of the wire cut-off and strain relief element 14 are parallel to the flat plate wire connector element 12. In the illustrated embodiment the end wall 24 is sharpened along its entire top edge so as to be sharpened in alignment with both of the wire connecting slots 21 in the wire connector element 12. The legs 25 forming the other end wall of the wire cut-off and strain relief element 14 project transversely into the path of a wire from each wire connecting slot 21 to the adjacent end of the insulating body 10 through wire entry slots 19. They are thus in position to engage the insulation on a wire connected in the wire connector element 12 to provide strain relief for the wire.

The insulating cover 11 is formed to telescope into the body 10. It has an open-sided wire receiving channel 32 along each of its sides, the surface of the cover facing the body 10 being cut away centrally to accommodate the wire connector element 12, the wire cut-off and strain relief element 14 and the posts 29. Latching projections 34 are formed at the edge of the lower surface of the cover 11 to fit between pairs of longitudinal latching ribs 35 and 36 projecting inward from the side walls 17 of the body 10. With cover projections 34 between latching ribs 35 and 36 the cover is in the open position with the wire receiving channels 32 in the cover 11 accessible for insertion of wires. Projections 38 are formed along the longitudinal edge of the upper portion of the cover 11 so that when the cover 11 is fully telescoped into the body 10 the upper latching projections 38 fit between the latching ribs 35 and 36 on the body 10 to retain the body and cover in the crimped position.

Figure 4:
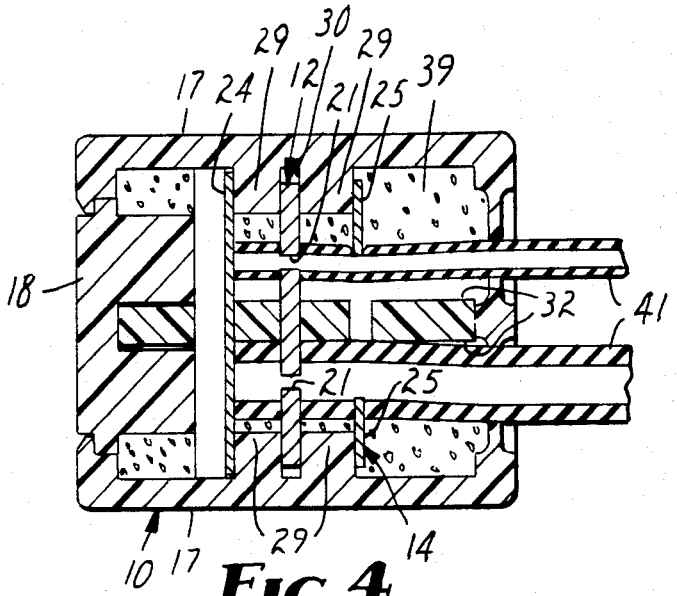
FIG. 4 is a transverse cross sectional view of the fully closed connector with the wires connected and strain relieved.
Figure 6:
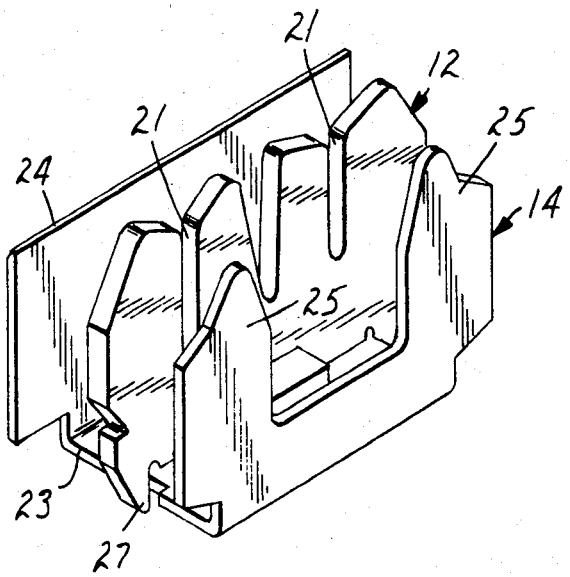
FIG. 6 is an isometric view of the conductive wire connector element and the metal wire cut-off and strain relief element contained within the electrical wire connector of FIGS. 1–5.
Figure 5:
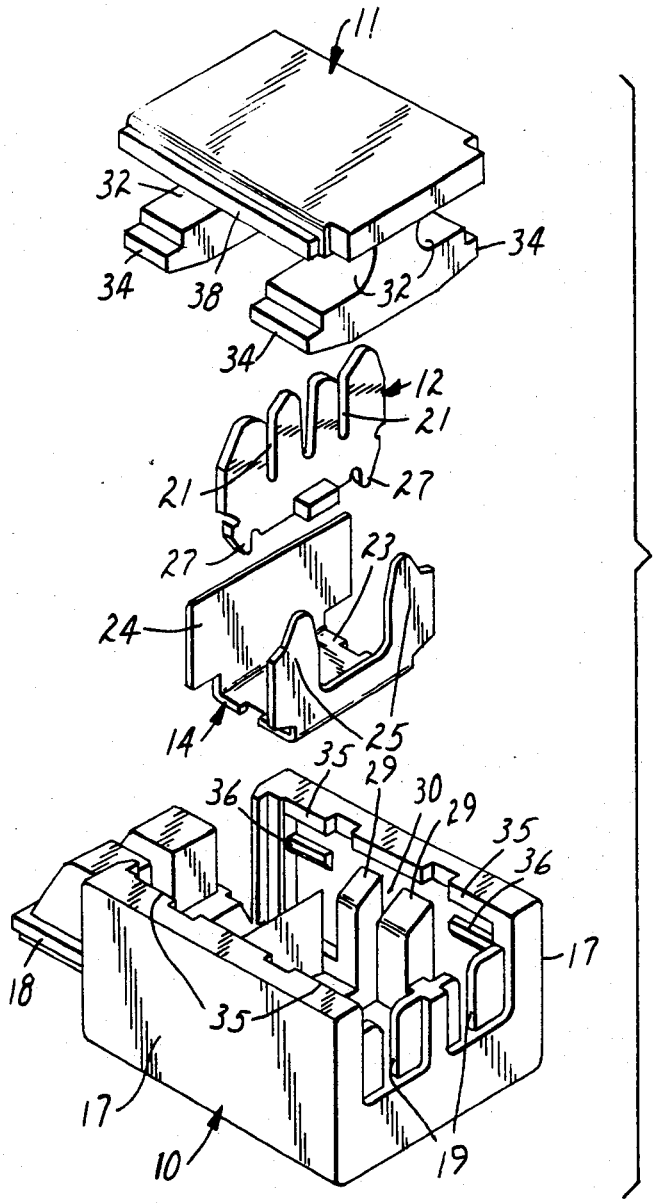
FIG. 5 is an exploded isometric view of the parts of the connector.

The connector is intended to be sold with the cover 11 and body 10 latched together in the open position and the body cavity normally filled with a waterproof grease 39. In use, an insulated wire 41 is inserted into each of the wire channels 32 in the cover 11. The cover 11 is then pressed into the body 10, usually with a parallel jaw crimping tool. The cover carries the wires 41 into the wire connecting slots 21 where the insulation on the wire is cut away and connection is made to the conductors of the wires 41. Simultaneously the cover presses the wires against the sharpened cut-off blade 24, severing the wire ends projecting out of the connector, and it carries the wires down along the strain relief legs 25 and into the wire entry slots 19, the strain relief legs engaging the insulation on the wires 41 to provide strain relief. As illustrated in FIG. 4, with a smaller gauge wire the strain relief legs 25 bend the wire in addition to engaging the insulation to provide adequate strain relief while with a larger diameter wire the greater indentation of insulation, and possibly even a small indentation of the conductor, provides the strain relief. It has been found that wires from 26 AWG through 19 AWG can be electrically connected and strain relieved in excess of 85% of the strength of the wires with the illustrated connector.

Finally, the hinged door 18 is closed to seal the end of the connector adjacent the cut-off ends of the wires 41. The pressing of the body 10 and cover 11 together, and the closing of the door 18 extrudes the waterproof grease 39 around the connected wires 41 within the connector to fully waterproof the connection.

I claim:

1. An electrical wire connector comprising:

a hollow, open-topped, insulating body having a base wall and a pair of generally parallel side walls extending generally perpendicularly from said base wall, a flat plate, wire connector element formed of a copper alloy with a plurality of wire connecting slots, said wire connector element being retained in said body perpendicular to said side walls and said base wall generally centrally of the length of said body for electrical connection of a plurality of insulated wires, a U-shaped wire cut-off and strain relief element of a metal having a hardness greater than that of said wire connector element, said wire cut-off and strain relief element having a base passing between the base wall of said body and said wire connector element and end walls parallel to said flat plate wire connector element, one of said end walls being sharpened along its top edge in alignment with at least one of said wire connecting slots in said wire connector element and the second end wall comprising at least one leg projecting transversely into the path of a wire from each wire connecting slot to the end of said insulating body adjacent said second end wall to engage the insulation on the wire and thereby to strain relieve the wire, and an insulating cover formed to telescope with said body, said cover having means to carry a wire into each said connector element slot and to cooperate with said sharpened end wall of said wire cut-off and strain relief element to sever at least one wire extending through said connector upon telescoping of said cover and said body fully together, said body and cover being formed with complementry latch members to retain said body and cover in an open position to permit one wire for each wire connecting slot in said wire connector element to be inserted through said connector between said body and cover and to retain said body and cover in a crimped position with said cover and body fully telescoped together.

2. The wire connector of claim 1 wherein said body and cover are formed with means to seal the end of said connector adjacent said sharpened end wall of said wire cut-off and strain relief element when said body and cover are fully telescoped together.

3. The wire connector of claim 2 wherein said means to seal the end of said connector comprises a hinged door.

4. The wire connector of claim 3 wherein one end wall of said wire cut-off and strain relief element is sharpened along its top edge in alignment with each of said wire connecting slots, and wherein with said body and cover fully telescoped together said hinged door seals the entire end of said connector when closed.

5. The wire connector of claim 1 wherein said wire connector element has two wire connecting slots and said second wall of said wire cut-off and strain relief element consists of two similar legs, one extending inward from each edge of said wire cut-off and strain relief element.

6. The wire connector of claim 1, 2, 3, 4 or 5 wherein said insulating cover has an open sided wire receiving channel along each of its sides which is accessible for insertion of a wire when said body and cover are in their open position.

* * * * *